US005814256A

United States Patent [19]

Greve et al.

[11] Patent Number: 5,814,256

[45] Date of Patent: Sep. 29, 1998

[54] PROCESS OF PRODUCING PREFORMS CONTAINING LIGHT WEIGHT FILLER PARTICLES

[75] Inventors: Bruce Norman Greve, Clarkston; Richard Freeman, Oxford, both of Mich.

[73] Assignee: The Budd Company, Troy, Mich.

[21] Appl. No.: 822,079

[22] Filed: Mar. 20, 1997

[51] Int. Cl.[6] ..... D21J 7/00

[52] U.S. Cl. ..... 264/86; 264/257; 264/DIG. 26; 162/116; 162/141; 162/145; 162/146; 162/148; 428/373

[58] Field of Search ..... 264/86, 257, DIG. 26; 428/373; 162/116, 141, 145, 146, 148

[56] References Cited

U.S. PATENT DOCUMENTS

| | | | |
|---|---|---|---|
| 2,612,679 | 10/1952 | Ladisch | 264/DIG. 26 |
| 4,740,346 | 4/1988 | Freeman | 264/258 |
| 4,849,147 | 7/1989 | Freeman | 264/138 |
| 4,863,771 | 9/1989 | Freeman | 264/257 |
| 5,039,465 | 8/1991 | Freeman | 264/86 |
| 5,091,252 | 2/1992 | Hruska | 428/370 |
| 5,286,326 | 2/1994 | Greve | 156/272.4 |

*Primary Examiner*—James Derrington
*Attorney, Agent, or Firm*—Harness, Dickey & Pierce, P.L.C.

[57] ABSTRACT

A method and apparatus of producing and using composite fibers in a liquid molding process. The composite fibers are formed from a base material and filler particles which are lighter or less expensive than the base material. A preform screen is placed at the bottom of a tank. The tank is filled with liquid, the composite fibers and a mass of reinforcing fibers creating a slurry above the screen. The screen is raised up through the slurry causing the composite fibers and the reinforcing fibers to be deposited on the screen creating a fiber preform. The preform is then removed from the screen and is placed in a mold for use in a liquid molding process.

10 Claims, 2 Drawing Sheets

PROCESS OF PRODUCING PREFORMS CONTAINING LIGHT WEIGHT FILLER PARTICLES

BACKGROUND OF THE INVENTION

1. Technical Field

The present invention relates to fiber reinforced plastic preforms and, more particularly, to preforms which include lightweight filler particles.

2. Discussion

Fiber reinforced plastic (FRP) parts are presently being used in a wide variety of applications and are finding increased popularity. Several methods of making FRP parts are known in the industry, such as resin transfer molding (RTM) and structural reaction injection molding (SRIM). RTM and SRIM are commonly known as liquid molding processes which are capable of producing composite components with many favorable properties. Some of the characteristics of these components include: dimensional accuracy, parts consolidation, joint efficiency, and high strength. In the liquid molding process fibrous material is placed in a mold and injected with a resin or other material which cures to form the finished part. Examples of the RTM process are disclosed in commonly assigned U.S. Pat. Nos. 4,740,346; 4,849,147; 4,863,771; and 5,286,326 which are hereby incorporated by reference. In the RTM process, fibrous material is often formed into a preliminary shape before being placed into the mold and is commonly referred to as a fiber preform. The shape of the preform generally conforms to the shape of the mold die surfaces into which it is placed. Preforms have been made by several different methods. One approach is to direct chop fibers onto a screen along with a binder. Another method is to make the preforms from mats of fibrous material. Still another technique is known as a wet slurry process as disclosed, for example, in Keown et al., "Wet Slurry Process Brings Precision To Reinforce Plastics". Further, an improved wet slurry process is disclosed in commonly assigned U.S. Pat. No. 5,039,465, which is also hereby incorporated by reference.

While several of these methods have realized great commercial success, there is a continuing need to add flexibility in component design. One area of particular interest in the industry is the ability to produce even lighter weight and more cost effective parts using the liquid molding process. Traditionally it has been difficult to introduce filler materials or light weight particles into the molding materials. As a result, the material costs and weight of components made using the liquid molding process have not been reduced as much as desired by many manufacturers.

SUMMARY OF THE INVENTION

Accordingly, the present invention provides a method of producing and using composite fibers for use in a liquid molding process. The composite fibers are formed from a base material and filler particles which are mixed in a generally uniform mixture prior to forming. The composite fibers are then placed in a tank filled with liquid along with a mass of reinforcing fibers. A preform screen, placed near the bottom of the tank prior to adding the composite fibers and reinforcing fibers, is raised through a slurry created by dispersing the fibers throughout the liquid in a substantially uniform concentration. The fibers are deposited on the preform screen as the liquid passes through the screen thereby creating a fiber preform having the reinforcing fibers and the composite fibers generally blended and uniform throughout. The fiber preform is then removed from the screen and inserted into a mold. Resin is then injected into the mold and impregnates the fiber preform. Upon curing the structure is removed from the mold.

DETAILED DESCRIPTION OF THE INVENTION

The following description of the preferred embodiment is merely exemplary in nature and is in no way intended to limit the invention or its application or uses.

Figure 1:
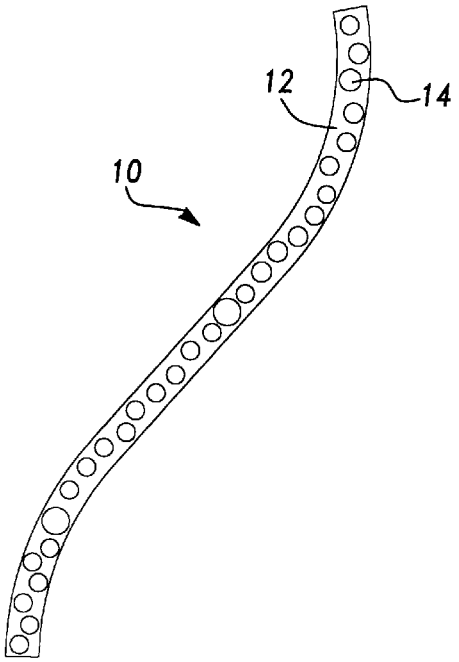
FIG. 1 is a sectional view of a composite fiber made in accordance with the teachings of the present invention which is enlarged for clarity.

Referring to FIG. 1, there is shown a composite fiber 10 which includes a base material 12 and filler particles 14 which are disposed within base material 12. Filler particles 14 generally have a lower material density than that of base material 12, or have a lower material cost per volume than that of base material 12, or ideally have a lower material density and a lower material cost per volume than that of base material 12. While in the preferred embodiment filler particles 14 are shown as spherical, generally representing spherical glass beads or phenolic spheres, other particles such as flyash and other shapes which are non-spherical may equally be incorporated in the practice of the present invention.

Base material 12 may be made of a variety of materials which are compatible with the filler particles 14 used in the particular application. In the preferred embodiment base material 12 is typically made of thermoplastic resins, such as polyethylene or polypropylene, while other appropriate materials include: polyamids, polyesters, polyacetals, and other thermoplastic and thermoset polymers.

Composite fiber 10 is formed by mixing base material 12 and filler particles 14 in a uniform mixture prior to forming by a number of a variety of methods. In the preferred embodiment, the filler particles 14 are incorporated into a matrix of base material 12 and are subsequently extruded into composite fibers 10. Other methods suitable for forming composite fiber 10 include casting, spinning or other conventional fiber forming methods.

Figure 2:
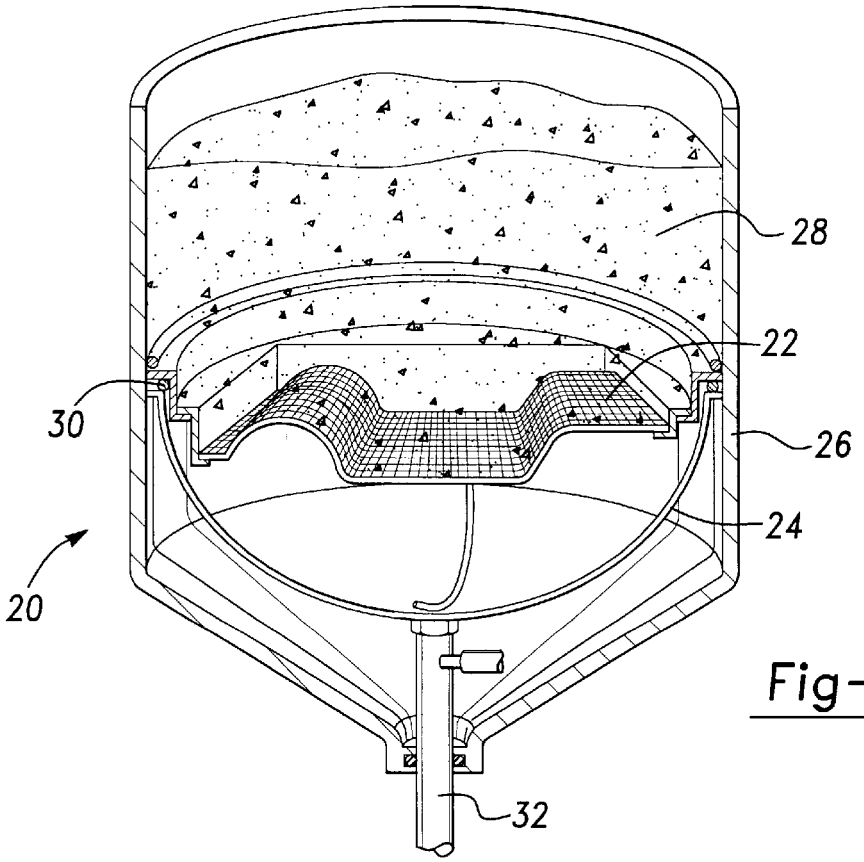
FIG. 2 is a front perspective view of the apparatus used in forming the fiber preform including the composite fiber of FIG. 1, the apparatus having the screen positioned in a starting position.

Referring now to FIG. 2, there is shown an apparatus 20 for making fiber preforms for use in a liquid molding process. Apparatus 20, shown in its starting position, utilizes a wet slurry process as disclosed in commonly assigned U.S. Pat. No. 5,039,465, which is hereby incorporated by reference. As shown in apparatus 20, a preform screen 22 is placed on a frame 24 and lowered to the bottom of a tank 26. The tank 26 is then filled with a liquid, preferably water, and the composite fibers 10 are added to the liquid along with a mass of reinforcing fibers. Composite fibers 10 and the mass of reinforcing fibers are then dispersed within the liquid thereby creating a substantially uniform slurry 28 above screen 22. Seals 30 are present between the screen 22 and tank 26 such that as screen 22 is raised to the top of tank 26 by frame 24 the liquid of slurry 28 passes through the openings of screen 22. Composite fibers 10 and the reinforcing fibers are deposited on screen 22 as the liquid flows through the openings. Frame 24 is attached to piston 32 which is actuated in order to raise frame 24 and screen 22 to the top of tank 26.

Figure 3:
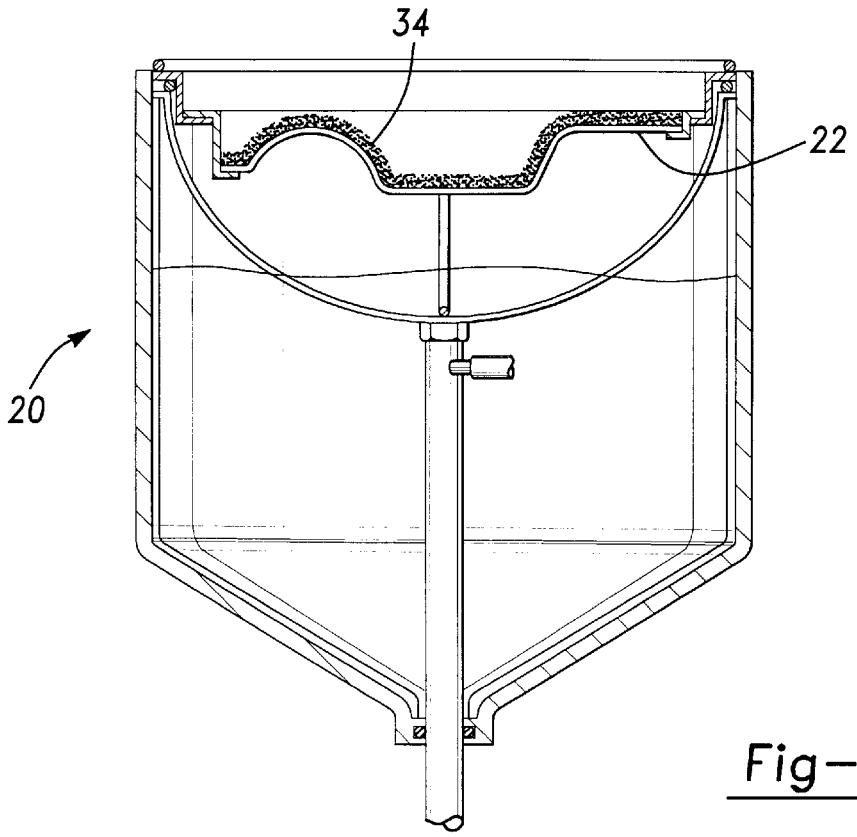
FIG. 3 is a front view of the apparatus of FIG. 2 after the screen has been raised to the top of the tank.

Additionally referring to FIG. 3, apparatus 20 is shown in its raised position wherein composite fibers 10 and the mass of reinforcing fibers have been deposited on screen 22 thereby forming a fiber preform 34. By dispersing the composite fibers and the reinforcing fibers in a generally uniform manner within slurry 28, the fiber preform 34 is a substantially uniform blend of composite fibers 10 and the reinforcing fibers. Any excess moisture remaining in fiber preform 34 can be removed by any number of methods such as heating preform 34 while on screen 22, or by removing preform 34 from screen 22 by use of a vacuum pickup (not shown) which can equally remove the moisture from fiber preform 34.

Figure 4:
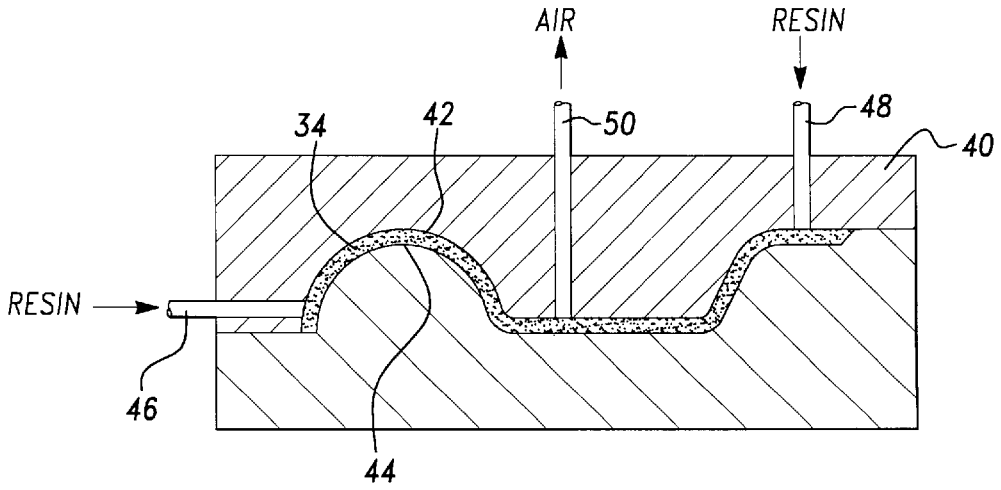
FIG. 4 is a sectional view of a mold used in the liquid molding process.

Once fiber preform 34 has been removed from screen 22 the preform 34 is placed in a mold 40 as shown in FIG. 4. Fiber preform 34 generally conforms to the mold surfaces 42 and 44 and is intended to require little or no secondary operations, such as edge trimming of preform 34. Once preform 34 has been placed in mold 40 resin is injected into the mold through conduits 46 and 48. A vent conduit 50 is also provided to permit the escape of air from preform 34 thereby preventing the formation of voids or other undesirable characteristics in the finished structure.

Depending upon the type of liquid molding process used, such as resin transfer molding (RTM) or structural reaction injection molding (SRIM) a variety of resins can be injected into mold 40 to impregnate the fiber preform 34. Typically RTM uses polyester, vinylester or epoxy. Further, SRIM generally utilizes urethane and a structural mat or reinforcement is added prior to closing mold 40 and injecting the resin. Once the resin has been injected into the mold and has impregnated the fiber preform, the resin cures and the structure produced can be removed and is ready for any subsequent processing required or is ready for end use.

It should be readily apparent to those skilled in the art that variations and modifications to the preferred embodiment described can be incorporated in the present invention. Several of those variations include mixing the composite fibers and the reinforcing fibers together prior to adding the fibers to the liquid, and varying the ratio of composite fibers to reinforcing fibers in order to provide a desired structure with a set of physical properties appropriate for the intended end use of the structure.

The present invention provides a simple, cost effective method and apparatus for incorporating lightweight filler particles or low cost filler particles into a fiber preform which is later used in a liquid molding process in order to produce a lightweight and/or low cost finished product.

The foregoing discussion discloses and describes a preferred embodiment of the present invention. One skilled in the art will readily recognize from such discussion, and from the accompanying drawings and claims, that various changes, modifications, and variations can be made therein without departing from the true spirit and fair scope of the invention as defined in the following claims.

What is claimed is:

1. A method of producing and using composite fibers for use in a liquid molding process, said method comprising the steps of:

mixing filler particles with a base material such that a generally uniform mixture is produced, said filler particles having a lower material density than that of said base material;

forming said uniform mixture of said filler particles and said base material to form composite fibers;

placing a preform screen near the bottom of a tank filled with a liquid;

adding said composite fibers and a mass of reinforcing fibers to said liquid to form a slurry in said tank;

dispersing said composite fibers and said reinforcing fibers within said liquid thereby creating a substantially uniform slurry; and processing said slurry to create a fiber preform upon said preform screen, wherein said reinforcing fibers and said composite fibers are generally blended and uniform throughout said fiber preform.

2. The method of claim 1 wherein said step of processing further comprises the steps of:

raising said preform screen to the top of said tank thereby causing said liquid of said slurry to flow through said preform screen;

depositing said composite fibers and said reinforcing fibers on said screen as said liquid flows through said screen, thereby forming said fiber preform; and removing said fiber preform from said preform screen.

3. The method of claim 2 further comprising the steps of:

placing said fiber preform in a mold;

injecting a resin into said mold to impregnate said fiber preform thereby forming a desired structure; and removing said structure from said mold.

4. The method of claim 1 wherein said composite fibers and said reinforcing fibers are mixed together prior to adding said composite fibers and said reinforcing fibers to said liquid.

5. The method of claim 4 wherein a ratio of said composite fibers to said reinforcing fibers is varied thereby providing a desired structure with a set of physical properties appropriate for the intended use of said structure.

6. The method of claim 1 wherein said step of forming said composite fibers comprises extruding said uniform mixture of material.

7. The method of claim 1 wherein said filler particles are spherical.

8. The method of claim 1 wherein said filler particles are glass beads.

9. The method of claim 1 wherein said filler particles are flyash.

10. The method of claim 1 wherein said filler particles are phenolic spheres.

* * * * *